US010655857B2

(12) United States Patent
Harding et al.

(10) Patent No.: US 10,655,857 B2
(45) Date of Patent: May 19, 2020

(54) COMBUSTION CHAMBER

(71) Applicant: ROLLS-ROYCE plc, London (GB)

(72) Inventors: Stephen C Harding, Bristol (GB); Paul A Hucker, Bristol (GB)

(73) Assignee: ROLLS-ROYCE PLC, London (GB)

( * ) Notice: Subject to any disclaimer, the term of this patent is extended or adjusted under 35 U.S.C. 154(b) by 286 days.

(21) Appl. No.: 15/637,209

(22) Filed: Jun. 29, 2017

(65) Prior Publication Data

US 2018/0031242 A1 Feb. 1, 2018

(30) Foreign Application Priority Data

Jul. 29, 2016 (GB) ..... 1613110.4

(51) Int. Cl.
*F23R 3/20* (2006.01)
*F23R 3/00* (2006.01)
(Continued)

(52) U.S. Cl.
CPC ..... *F23R 3/20* (2013.01); *F23R 3/002* (2013.01); *F23R 3/08* (2013.01); *F23R 3/44* (2013.01);
(Continued)

(58) Field of Classification Search
CPC .. F23R 2900/00005; F23R 2900/00012; F23R 2900/00017; F23R 2900/03041;
(Continued)

(56) References Cited

U.S. PATENT DOCUMENTS 4,158,949 A * 6/1979 Reider ..... F23R 3/50 60/737
4,302,941 A 12/1981 DuBell
(Continued)

FOREIGN PATENT DOCUMENTS

EP 3054218 A1 8/2016
EP 3 130 853 A1 2/2017
(Continued)

OTHER PUBLICATIONS

Oct. 25, 2017 Search Report issued in European Patent Application No. 17178733.
(Continued)

*Primary Examiner* — Todd E Manahan
*Assistant Examiner* — David P. Olynick
(74) *Attorney, Agent, or Firm* — Oliff PLC

(57) ABSTRACT

A gas turbine engine combustion chamber includes upstream and downstream ring structures and a plurality of circumferentially arranged combustion chamber segments. Each segment extends the full length of the combustion chamber and each segment is secured to the upstream ring structure and is mounted on the downstream ring structure. The upstream end of each combustion chamber segment includes a surface having a plurality of circumferentially spaced radially extending holes and the upstream ring structure having a plurality of circumferentially spaced holes extending radially through a portion abutting the surface of the upstream end of each combustion chamber segment. Each combustion chamber segment being removably secured to the upstream ring structure by a plurality of fasteners locatable in the holes in the combustion chamber segment and corresponding holes in the upstream ring structure.

17 Claims, 11 Drawing Sheets

(51) Int. Cl.

| | |
|---|---|
| ***F23R 3/60*** | (2006.01) |
| ***F23R 3/08*** | (2006.01) |
| ***F23R 3/44*** | (2006.01) |
| ***F23R 3/46*** | (2006.01) |

(52) U.S. Cl.
CPC ..... *F23R 3/46* (2013.01); *F23R 3/60* (2013.01); *F23R 2900/00005* (2013.01)

(58) Field of Classification Search
CPC .. F23R 2900/03044; F23R 3/002; F23R 3/08; F23R 3/50; F23R 3/60; F23R 3/04; F01D 25/265
USPC ..... 60/737, 748, 752–760, 804
See application file for complete search history.

(56) References Cited

U.S. PATENT DOCUMENTS

| | | | | |
|---|---|---|---|---|
| 4,414,816 | A * | 11/1983 | Craig | F23R 3/002 60/757 |
| 4,446,693 | A | 5/1984 | Pidcock et al. | |
| 5,524,430 | A | 6/1996 | Mazeaud et al. | |
| 6,434,821 | B1 | 8/2002 | Nelson et al. | |
| 6,449,952 | B1 * | 9/2002 | Emilianowicz | F01D 25/243 60/752 |
| 7,017,350 | B2 | 3/2006 | De Sousa et al. | |
| 7,062,920 | B2 | 6/2006 | McMasters et al. | |
| 7,673,457 | B2 | 3/2010 | Bessagnet et al. | |
| 7,757,495 | B2 | 7/2010 | Bessagnet et al. | |
| 7,849,696 | B2 | 12/2010 | De Sousa et al. | |
| 8,893,382 | B2 | 11/2014 | Patterson et al. | |
| 2005/0132707 | A1 | 6/2005 | Gebhardt | |
| 2008/0236164 | A1 * | 10/2008 | Bunel | F23R 3/10 60/740 |
| 2008/0256955 | A1 * | 10/2008 | Parkman | F23R 3/002 60/752 |
| 2010/0095680 | A1 * | 4/2010 | Rudrapatna | F23R 3/002 60/754 |
| 2014/0360196 | A1 * | 12/2014 | Graves | F23R 3/002 60/753 |
| 2015/0241062 | A1 | 8/2015 | Harding | |
| 2016/0377296 | A1 * | 12/2016 | Bangerter | F02K 1/822 60/752 |

FOREIGN PATENT DOCUMENTS

| | | | | |
|---|---|---|---|---|
| FR | 2965604 | A1 * | 4/2012 | F23R 3/002 |
| GB | 2 432 902 | A | 6/2007 | |
| GB | 2432902 | B | 1/2011 | |

OTHER PUBLICATIONS

Dec. 7, 2016 Search Report issued in Great Britain Patent Application No. 1613110.4.

* cited by examiner

COMBUSTION CHAMBER

The present disclosure relates to a combustion chamber and a combustion chamber segment and in particular to a gas turbine engine combustion chamber and a gas turbine engine combustion chamber segment.

A conventional annular combustion chamber comprises an annular radially inner wall and an annular radially outer wall secured to an annular upstream end wall. In the case of an annular combustion chamber mounted at its downstream end the annular radially outer wall is secured to an annular support member. The annular radially inner wall and the annular radially outer wall may be provided with tiles to protect the annular radially inner wall and the annular radially outer wall from the heat produced by the combustion process.

In operation a combustion chamber may be subjected to ultimate load situations, e.g. during compressor surge or combustion chamber flame out, when relatively high radial loads are exerted onto the combustion chamber.

It has been proposed to make the annular radially inner wall and the annular radially outer wall of an annular combustion chamber from combustion chamber segments. However, an annular combustion chamber comprising combustion chamber segments must be able to withstand the ultimate load situations. Therefore, these combustion chamber segments have been welded together and this negates some of the advantages of combustion chamber segments.

Therefore the present disclosure seeks to provide a novel combustion chamber and a novel combustion chamber segment which reduces or overcomes the above mentioned problem.

According to a first aspect of the invention there is provided a combustion chamber comprising an upstream ring structure, a downstream ring structure and a plurality of circumferentially arranged combustion chamber segments, each combustion chamber segment extending the full length of the combustion chamber, each combustion chamber segment comprising a frame structure and an inner wall, the frame structure and the inner wall being integral, an upstream end of each combustion chamber segment being secured to the upstream ring structure and a downstream end of each combustion chamber segment being mounted on the downstream ring structure, wherein the upstream end of each combustion chamber segment comprises a surface having a plurality of circumferentially spaced radially extending holes, the upstream ring structure having a plurality of circumferentially spaced holes extending radially through a portion abutting the surface of the upstream end of each combustion chamber segment and each combustion chamber segment being removably secured to the upstream ring structure by a plurality of fasteners locatable in the holes in the combustion chamber segment and corresponding holes in the upstream ring structure, each combustion chamber segment having a hole cooperating with a corresponding hole in the upstream ring structure to circumferentially position the combustion chamber segment relative to the upstream ring structure and each combustion chamber segment having a further hole cooperating with a further corresponding hole in the upstream ring structure to allow relative circumferential thermal expansion between the combustion chamber segment and the upstream ring structure wherein one of the further hole and the further corresponding hole being circumferentially slotted.

Each combustion chamber segment being removably secured to the upstream ring structure to allow differential thermal expansion and/or contraction between the combustion chamber segments and the upstream ring structure.

The upstream ring structure may have a plurality of first holes and a plurality of second holes, the first and second holes being arranged circumferentially alternately around the upstream ring structure, each first hole has the same diameter as the diameter of the holes in the frame structure of the combustion chamber segments, each second hole is circumferentially slotted, each first hole is aligned axially and circumferentially with a hole in a corresponding combustion chamber segment and each second hole is aligned axially with another hole in the corresponding combustion chamber segment to allow relative circumferential thermal expansion between the combustion chamber segment and the upstream ring structure.

The frame structure at the upstream end of each combustion chamber segment may have a first hole and a circumferentially spaced second hole, the first and second holes of the combustion chamber segments being arranged circumferentially alternately, each first hole has the same diameter as the diameter of the holes in the upstream ring structure, each second hole is circumferentially slotted, each first hole is aligned axially and circumferentially with a corresponding hole in the upstream ring structure and each second hole is aligned axially with a corresponding hole in the upstream ring structure to allow relative circumferential thermal expansion between the combustion chamber segment and the upstream ring structure.

The combustion chamber may be an annular combustion chamber or a tubular combustion chamber.

The combustion chamber segments may form a radially outer annular wall of the annular combustion chamber.

The upstream end of each combustion chamber segment may be removably secured to the upstream ring structure by nuts and bolts.

The combustion chamber segments may form a radially inner annular wall of the annular combustion chamber.

The combustion chamber may be a gas turbine engine combustion chamber.

The gas turbine engine may be an aero gas turbine engine, a marine gas turbine engine, an industrial gas turbine engine or an automotive gas turbine engine.

The aero gas turbine engine may be a turbofan gas turbine engine, a turbojet gas turbine engine, a turbo propeller gas turbine engine or a turbo shaft gas turbine engine.

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

Figure 1:
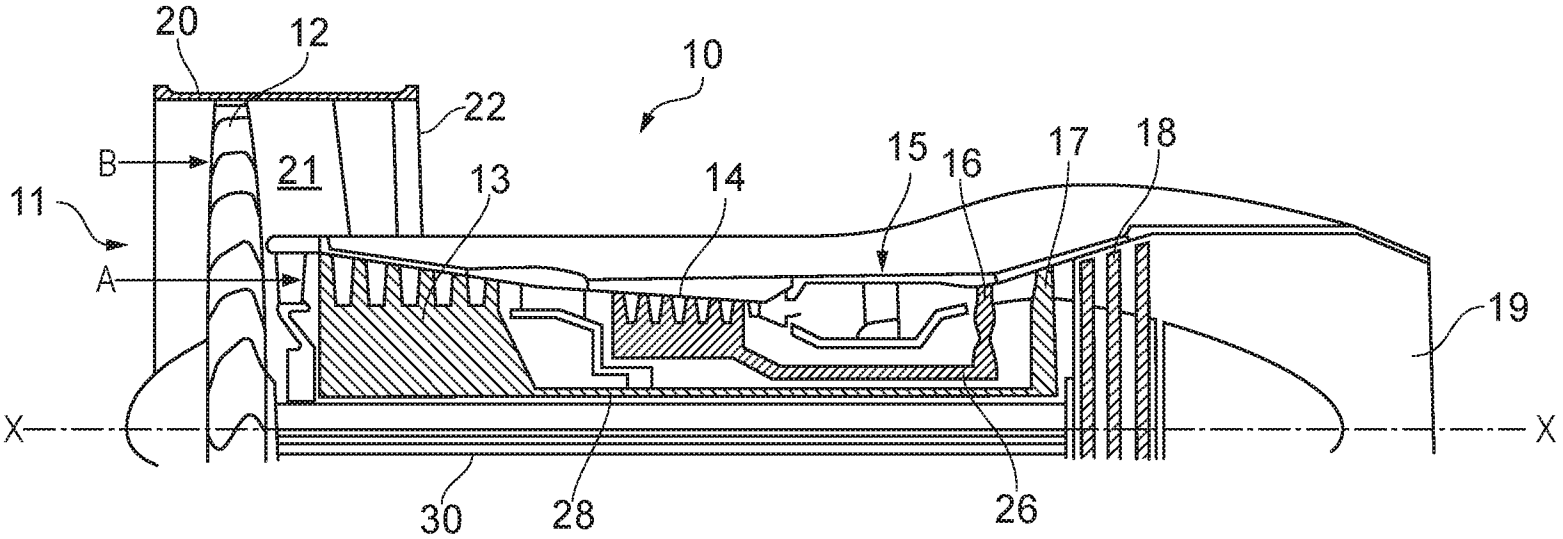
FIG. 1 is partially cut away view of a turbofan gas turbine engine having a combustion chamber comprising combustion chamber segments according to the present disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. The fan 12 is arranged within a fan casing 20 which defines a fan, or bypass, duct 21 and the fan duct 21 has a fan exhaust 22. In operation air flows into the intake 11 and is compressed by the fan 12. A first portion of the air A flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leave the low pressure turbine 18 and flow through the exhaust 19 to provide propulsive thrust. A second portion of the air flow B bypasses the main engine and flows through the fan duct 21 and through the fan exhaust 22 to provide propulsive thrust.

Figure 2:
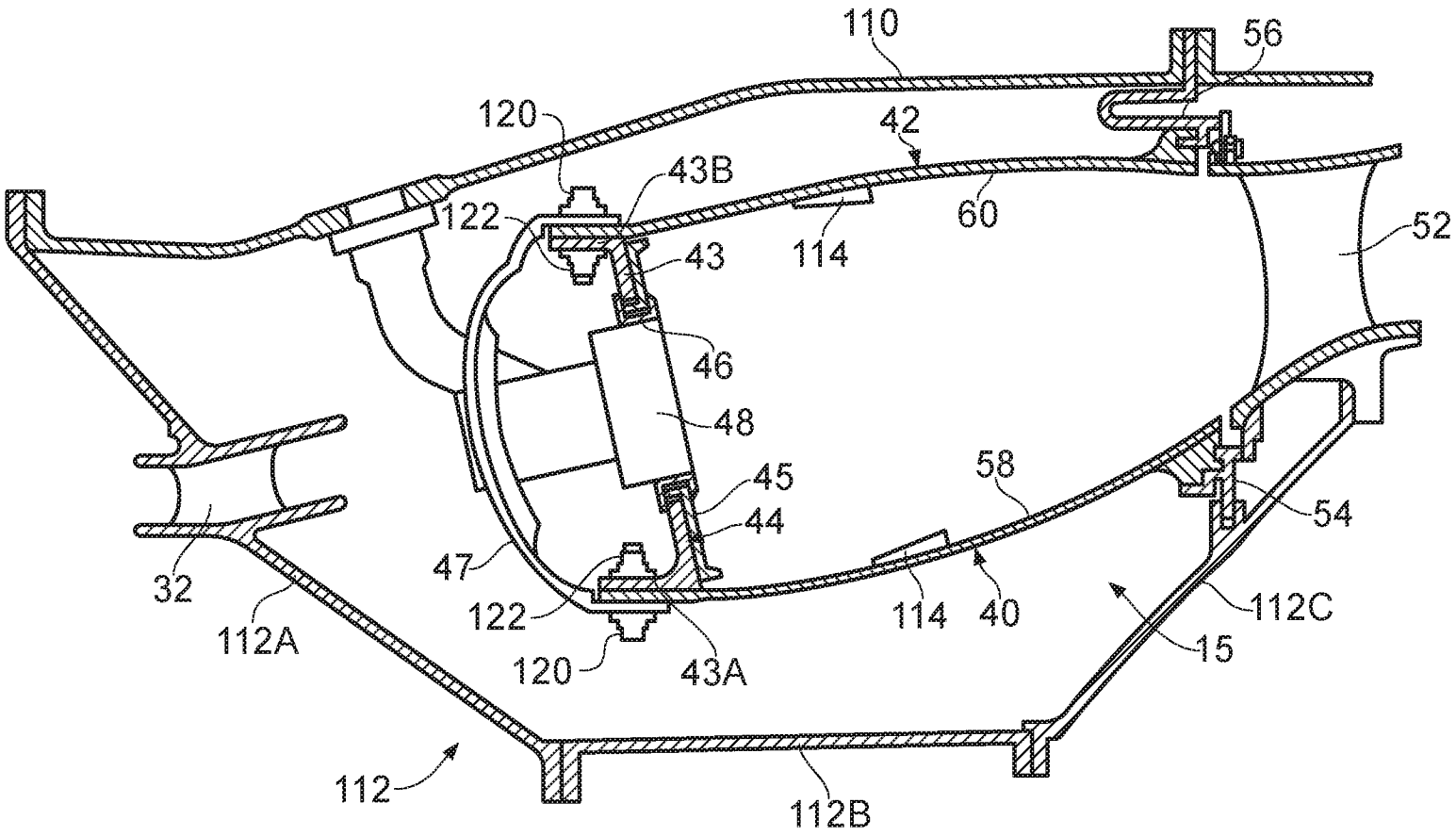
FIG. 2 is an enlarged cross-sectional view of a combustion chamber comprising combustion chamber segments according to the present disclosure.

The combustion chamber 15, as shown more clearly in FIG. 2, is an annular combustion chamber and comprises a radially inner annular wall structure 40, a radially outer annular wall structure 42 and an upstream end wall structure 44. The upstream end of the radially inner annular wall structure 40 is secured to the upstream end wall structure 44 and the upstream end of the radially outer annular wall structure 42 is secured to the upstream end wall structure 44. The upstream end wall structure 44 comprises an upstream end wall 43, a heat shield 45 and a cowl 47. The heat shield is positioned axially downstream of and secured to the upstream end wall 43 to protect the upstream end wall 43 from the combustion gases in the annular combustion chamber 15. The cowl 47 is positioned axially upstream of and secured to the upstream end wall 43. The combustion chamber 15 has a plurality of fuel injectors 48 and the fuel injectors 48 are arranged to supply fuel into the annular combustion chamber 15 during operation of the gas turbine engine 10. The upstream end wall 43 has a plurality of circumferentially spaced apertures 46 and each aperture 46 has a respective one of the plurality of fuel injectors 48 located therein. The heat shield 45 and the cowl 47 also each have a plurality of circumferentially spaced apertures and each aperture in the heat shield 45 and the cowl 47 is aligned with a corresponding aperture 46 in the upstream end wall 43. A plurality of circumferentially arranged compressor outlet guide vanes 32 are positioned axially upstream of the combustion chamber 15 and are arranged to direct the compressed air from the high pressure compressor 14 into the annular combustion chamber 15. A plurality of circumferentially arranged turbine nozzle guide vanes 52 are positioned axially downstream of the combustion chamber 15 and are arranged to direct the hot gases from the annular combustion chamber 15 into the high pressure turbine 16.

The annular combustion chamber 15 is positioned radially between a radially outer combustion chamber casing 110 and a radially inner combustion chamber casing 112. The radially inner combustion chamber casing 112 comprises a first, upstream, portion 112A, a second, intermediate, portion 1128 and a third, downstream, portion 112C. The upstream end of the first portion 112A of the radially inner combustion chamber casing 112 is removably secured to the upstream end of the radially outer combustion chamber casing 110. In this example a flange at the upstream end of the first portion 112A of the radially inner combustion chamber casing 112 is removably secured to a flange at the upstream end of the radially outer combustion chamber casing 110 by suitable fasteners, e.g. nuts and bolts, passing through the flanges. The downstream end of the first portion 112A of the radially inner combustion chamber casing 112 is removably secured to the upstream end of the second portion 1128 of the radially inner combustion chamber casing 112. In this example a flange at the upstream end of the second portion 1128 of the radially inner combustion chamber casing 112 is removably secured to a flange at the downstream end of the first portion 112A of the radially inner combustion chamber casing 112 by suitable fasteners, e.g. nuts and bolts, passing through the flanges. The downstream end of the second portion 1128 of the radially inner combustion chamber casing 112 is removably secured to the upstream end of the third portion 112C of the radially inner combustion chamber casing 112 and the downstream end of the third portion 112C of the radially inner combustion chamber casing 112 is removably secured to the radially inner ends of the turbine nozzle guide vanes 52. In this example a flange at the upstream end of the third portion 112C of the radially inner combustion chamber casing 112 is removably secured to a flange at the downstream end of the second portion 1128 of the radially inner combustion chamber casing 112 by nuts and bolts passing through the flanges and flanges on the turbine nozzle guide vanes 52 are removably secured to a flange at the downstream end of the third portion 112C of the radially inner combustion chamber casing 112 by nuts and bolts passing through the flanges.

The first portion 112A of the radially inner combustion chamber casing 112 is generally frustoconical and extends radially inwardly and axially downstream from its upstream end to the radially outer ends of the compressor outlet guide vanes 32 and extends radially inwardly and axially downstream from the radially inner ends of the compressor outlet guide vanes 32 to its downstream end. The second portion 112B of the radially inner combustion chamber casing 112 is generally cylindrical. The third portion 112C of the radially inner combustion casing 112 is generally frusto-conical and extends radially outwardly and axially downstream from its upstream end to the radially inner ends of the turbine nozzle guide vanes 52.

The upstream end wall 43 has an inner annular flange 43A extending in an axially upstream direction therefrom and an outer annular flange 43B extending in an axially upstream direction therefrom. The upstream end wall 43 forms a radially inner upstream ring structure and a radially outer upstream ring structure. A radially inner downstream ring structure 54 is mounted off the radially inner combustion chamber casing 112 and a radially outer downstream ring structure 56 is mounted off the radially outer combustion chamber casing 110. The radially inner annular wall structure 40 of the annular combustion chamber 15 and the radially outer annular wall structure 42 of the annular combustion chamber 15 comprise a plurality of circumferentially arranged combustion chamber segments 58 and 60 respectively. It is to be noted that the combustion chamber segments 58, 60 extend the full axial, longitudinal, length of the annular combustion chamber 15.

Figure 3:
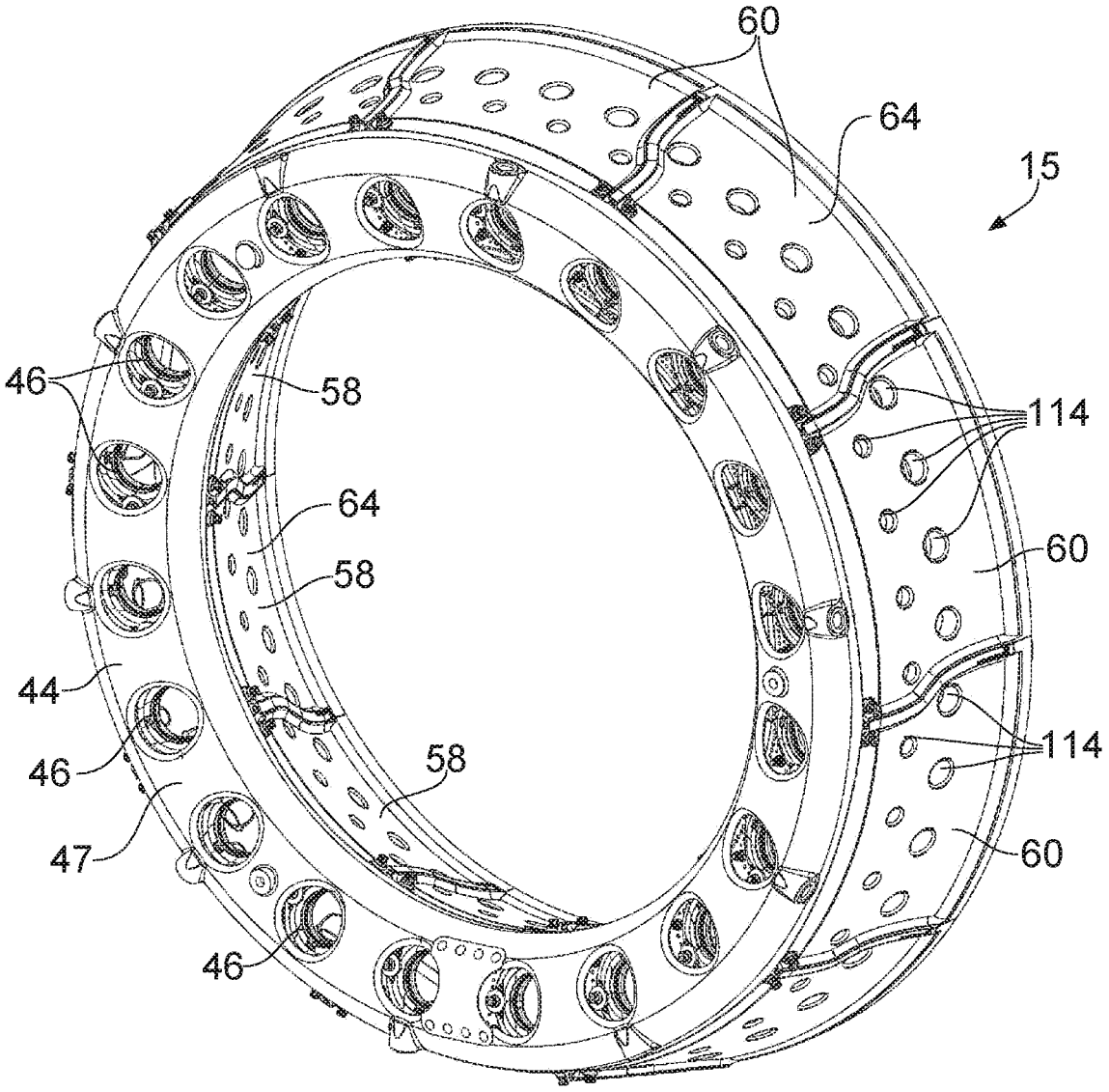
FIG. 3 is a perspective view of a combustion chamber comprising combustion chamber segments according to the present disclosure.

The circumferential arrangement of combustion chamber segments 58 and 60 of the radially inner and radially outer annular wall structures 40 and 42 of the annular combustion chamber 15 are clearly shown in FIG. 3. In this example there are ten combustion chamber segments 58 and ten combustion chamber segments 60 and each combustion chamber segment 58 and 60 extends through an angle of 36°. Other suitable numbers of combustion chamber segments 58 and 60 may be used, e.g. two, three, four, five, six, eight or twelve, and the number of combustion chamber segments 58 may be the same as or different to the number of combustion chamber segments 60. It is preferred that each of the combustion chamber segments extends through the same angle, but it may be possible to arrange the combustion chamber segments to extend through different angles.

Figure 4:
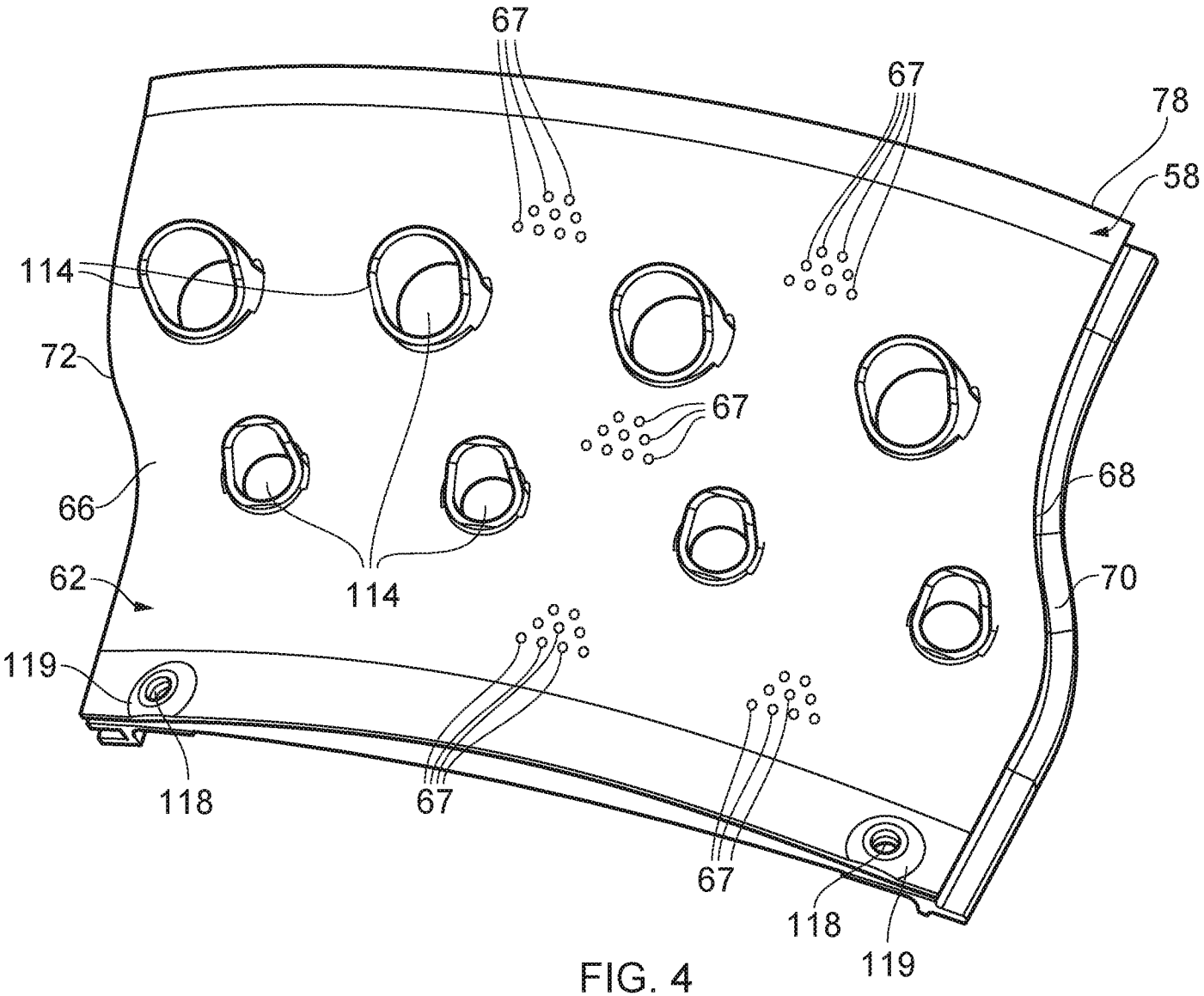
FIG. 4 is a further enlarged perspective view of a hot side of a combustion chamber segment shown in FIG. 3.
Figure 5:
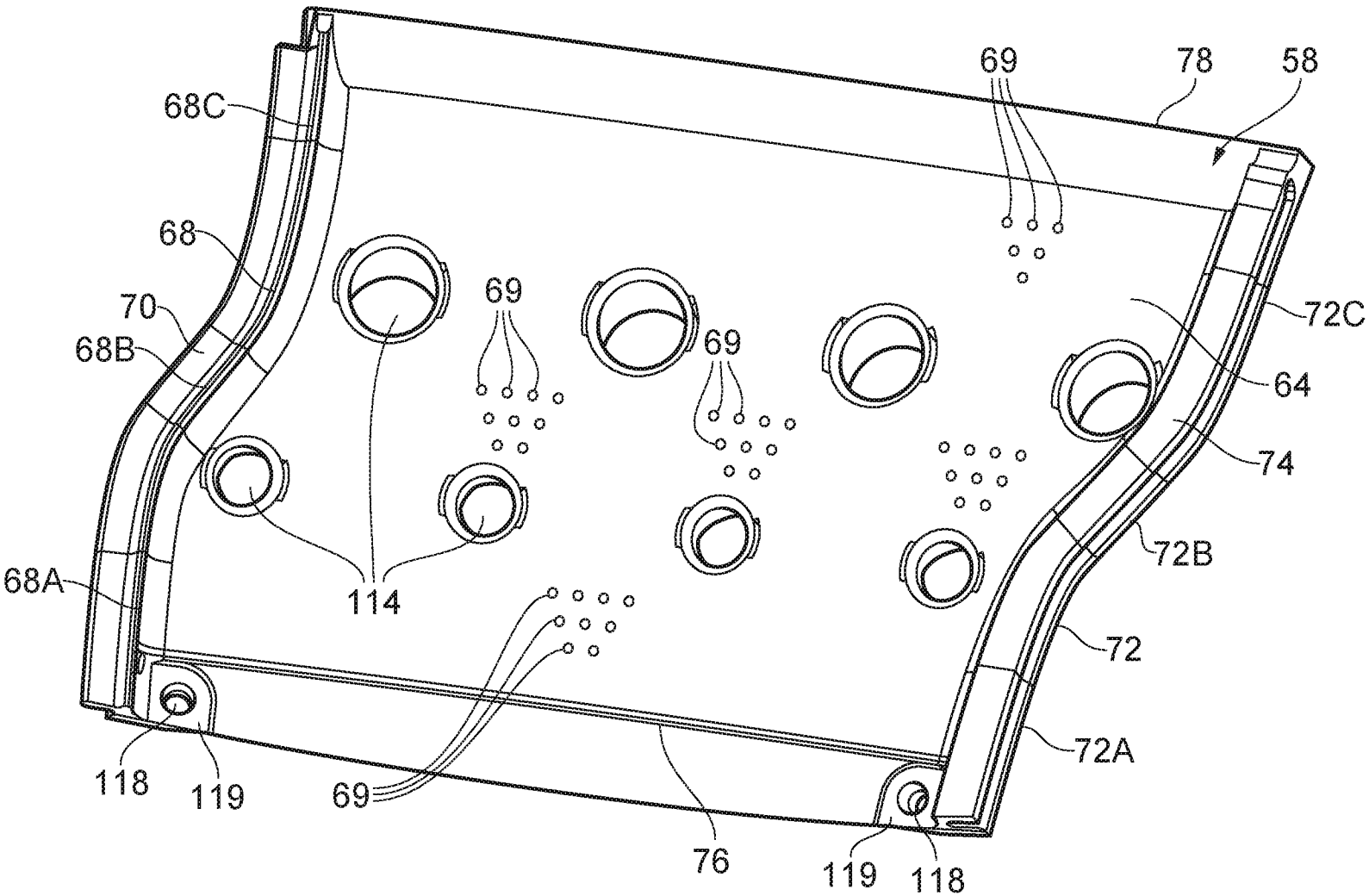
FIG. 5 is a further enlarged perspective view of a cold side of a combustion chamber segment shown in FIG. 3.
Figure 6:
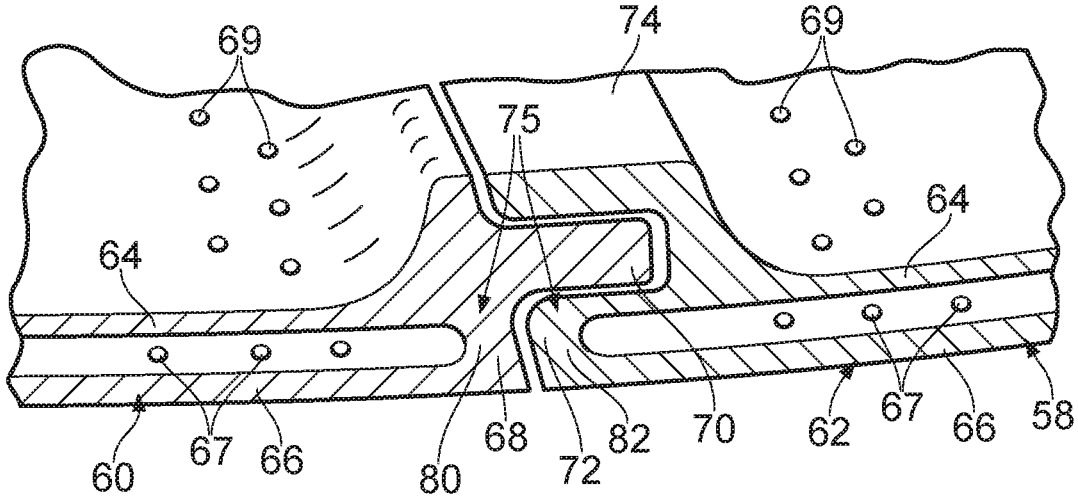
FIG. 6 is a further enlarged cross-sectional view through the portions of the edges of two adjacent combustion chamber segments shown in FIG. 3.

Each combustion chamber segment 58 and 60, as shown in FIGS. 4, 5 and 6, comprises a box like structure 62 including an outer wall 64 and an inner wall 66 spaced from the outer wall 64. The outer wall 64 and the inner wall 66 are arcuate. FIGS. 4, 5 and 6 show a combustion chamber segment 58 of the radially inner annular wall structure 40, but the combustion chamber segment 60 of the radially outer annular wall structure 42 are substantially the same as those of the radially inner annular wall structure 40. The outer wall 64 has a plurality of apertures 69 for the supply of coolant into the box like structure 62 and the inner wall 66 has a plurality of apertures 67 for the supply of coolant out of the box like structure 62. A first edge 68 of the box like structure 62 has a first hook 70 extending from the outer wall 64 and away from the inner wall 66. The first hook 70 extends at least a portion of the axial, longitudinal, length of the box like structure 62 and the first hook 70 is arranged at a first radial distance from the outer wall 64. A second edge 72 of the box like structure 62 has a second hook 74 extending from the outer wall 64 and away from the inner wall 66. The second hook 74 extends at least a portion of the axial, longitudinal, length of the box like structure 62, the second hook 74 is arranged at a second radial distance from the outer wall 64 and the second radial distance is greater than the first radial distance. The first hook 70 of each combustion chamber segment 58, 60 engages the outer wall 64 at the second edge 72 of an adjacent combustion chamber segment 58, 60 and the second hook 74 of each combustion chamber segment 58, 60 engages the first hook 70 of an adjacent combustion chamber segment 58, 60 to form a seal and to distribute loads between the adjacent combustion chamber segments 58, 60 and to maintain a circular profile, shape, for the radially inner, or radially outer, annular wall structure 40 and 42 of the annular combustion chamber 15, e.g. to prevent dislocation of the combustion chamber segments 58, 60. Thus, the first hook 70 of each combustion chamber segment 58, 60 contacts, abuts, or is in close proximity to the surface of the outer wall 64 at the second edge 72 of the adjacent combustion chamber segment 58, 60 and the second hook 74 of each combustion chamber segment 58, 60 contacts, abuts, or is in close proximity to the surface of the first hook 70 at the first edge 68 of the adjacent combustion chamber segment 58, 60. The first hook 70 of each combustion chamber segment 60 is arranged radially outwardly of the outer wall 64 at the second edge 72 of the adjacent combustion chamber segment 60 and the second hook 74 of each combustion chamber 60 is arranged radially outwardly of the first hook 70 at the first edge 68 of the adjacent combustion chamber segment 60. Similarly, the first hook 70 of each combustion chamber segment 58 is arranged radially inwardly of the outer wall 64 at the second edge 72 of the adjacent combustion chamber segment 58 and the second hook 74 of each combustion chamber 58 is arranged radially inwardly of the first hook 70 at the first edge 68 of the adjacent combustion chamber segment 58.

The upstream end of each combustion chamber segment 58, 60 is secured, e.g. removably secured, to the upstream ring structure 43 and the downstream end of each combustion chamber segment 58, 60 is secured, e.g. removably secured, to the downstream ring structure 54, 56. Thus, the upstream end of each combustion chamber segment 58 is secured to the upstream ring structure, e.g. the upstream end wall, 43 and the downstream end of each combustion chamber segment 58 is secured to the radially inner downstream ring structure 54. Similarly, the upstream end of each combustion chamber segment 60 is secured to the upstream ring structure, e.g. the upstream end wall, 43 and the downstream end of each combustion chamber segment 60 is secured to the radially outer downstream ring structure 56.

The first hook 70 extends the length of the box like structure 62 between a securing arrangement and a mounting arrangement and the second hook 74 also extends the length of the box like structure 62 between the securing arrangement and the mounting arrangement. The securing arrangement and the mounting arrangement are discussed further below.

However, it may be possible for the first hook to extend the full length of the box like structure and for the second hook to extend the full length of the box like structure. The size of the first hook and second hook may be the same along the full length of the box like structure, but the size of the first hook and second hook may vary along the length of the box like structure to match local requirements. The size of the first hook and second hook refers to the circumferential length. Alternatively, it may be possible for the first hook to extend only a part of the full length of the box like structure and for the second hook to extend only a part of the full length of the box like structure corresponding to the part of the full length of the first hook so that it inter-engages with a first hook of an adjacent box like structure. Additionally, it may be possible for there to be a plurality of first hooks arranged along the length of the box like structure and for there to be a corresponding number of second hooks arranged along the length of the box like structure so that each second hook inter-engages with a first hook of an adjacent box like structure.

The box like structure 62 of each combustion chamber segment 58, 60 has a first end wall 76 extending from a first, upstream, end of the outer wall 64 to a first, upstream, end of the inner wall 66, a second end wall 78 extending from a second, downstream and opposite, end of the outer wall 64 to a second, downstream and opposite, end of the inner wall 66. A first edge wall 80 extending from a first circumferential edge of the outer wall 64 to a first circumferential edge of the inner wall 66, a second edge wall 82 extending from a second, opposite circumferential, edge of the outer wall 64 to a second, opposite circumferential, edge of the inner wall 66 to form the box like structure 62.

The box like structure 62 of each combustion chamber segment 58, 60 comprises a frame structure 75. The frame structure 75 comprises the first and second end walls 76 and 78 and the first and second edge walls 80 and 82. The first and second end walls 76 and 78 and the first and second edge walls 80 and 82 are integral, e.g. one piece. The frame structure 75 of each combustion chamber segment 58, 60 is radially thicker, and stiffer, than the outer wall 64 and the inner wall 66 and the first and second end walls 76 and 78 and the first and second edge walls 80 and 82 are thicker axially and thicker circumferentially respectively than the radial thickness of the outer and inner walls 64 and 66 in order to carry loads and interface with adjacent combustion chamber segments 58, 60 and the upstream ring structure and the downstream ring structure. The frame structure 75 of each combustion chamber segment 58, 60 is arranged to carry the structural loads, the thermal loads, surge loads, g-force loads and flameout loads. The first hook 70 is provided on the first edge wall 80 and the second hook 74 is provided on the second edge wall 82. In other words the box like structure 62 of each combustion chamber segment 58, 60 comprises the frame structure 75 and portions of the outer and inner walls 64 and 66 extending axially, longitudinally, between the first and second end walls 76 and 78 and extending circumferentially, laterally, between the first and second edge walls 80 and 82. The outer wall 64 and the inner wall 66 are also integral with the frame structure 75, e.g. the outer wall 64, the inner wall 66 and the frame structure 75 are a single piece, a monolithic piece. The thickness of the inner wall 66 and/or the outer wall 64 may be varied longitudinally, axially, and circumferentially to control the stiffness of the stiffness of the inner wall 66 and/or the outer wall 64 to minimise stresses and strains and to provide gradual change in stiffness from the frame structure 75 to the inner wall 66 and/or outer wall 64. The inner wall 66 and/or the outer wall 64 are thicker adjacent to the frame structure 75 and decrease in thickness away from the frame structure 75.

Each combustion chamber segment comprises an integral structure, e.g. a single piece or monolithic piece, formed by additive layer manufacturing. The apertures in the outer wall, the apertures in the inner wall and any structure or structures, e.g. cellular structure or pedestals, between the inner and outer wall are all formed by the additive layer manufacturing (ALM) process. The additive layer manufacturing process may be direct laser deposition (DLD), selective laser sintering, direct electron beam deposition, laser powder bed etc. The combustion chamber segments are built using the additive layer manufacturing by initially starting from the upstream end, or the downstream end, of the combustion chamber segment. The combustion chamber segment is built up layer by layer using additive layer manufacturing in the longitudinal, axial, direction of the wall which corresponds to the direction of flow of hot gases over the second surface of the wall. However, the combustion chamber segment may be built up in other suitable directions, e.g. radial or circumferential direction of the wall.

Thus, the combustion chamber comprises an upstream ring structure, a downstream ring structure and a plurality of circumferentially arranged combustion chamber segments. Each combustion chamber segment extends the full axial, longitudinal, length of the combustion chamber.

Figure 7:
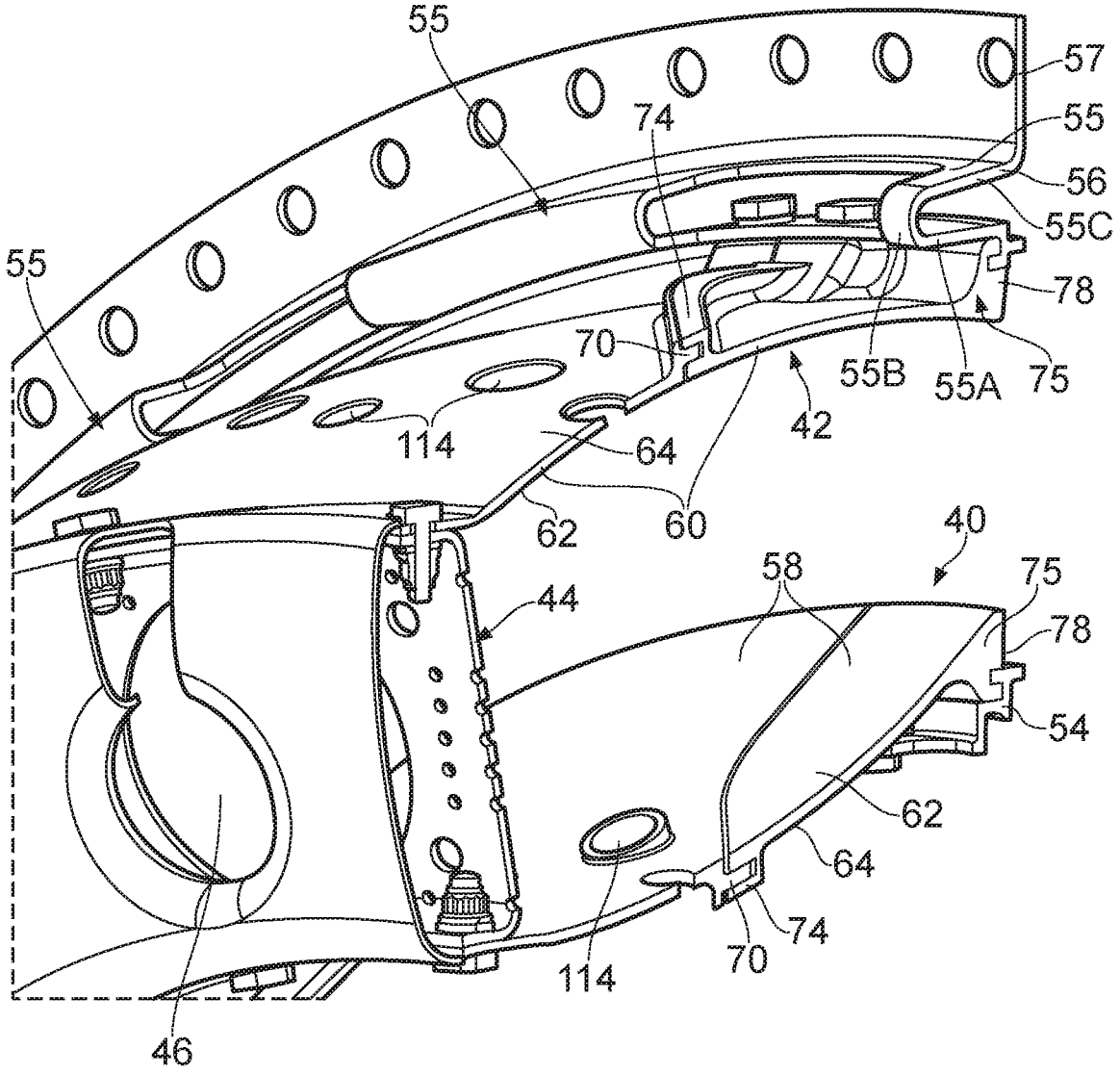
FIG. 7 is a further enlarged partially cut-away view perspective view showing the downstream end of the combustion chamber shown in FIG. 2.
Figure 8:
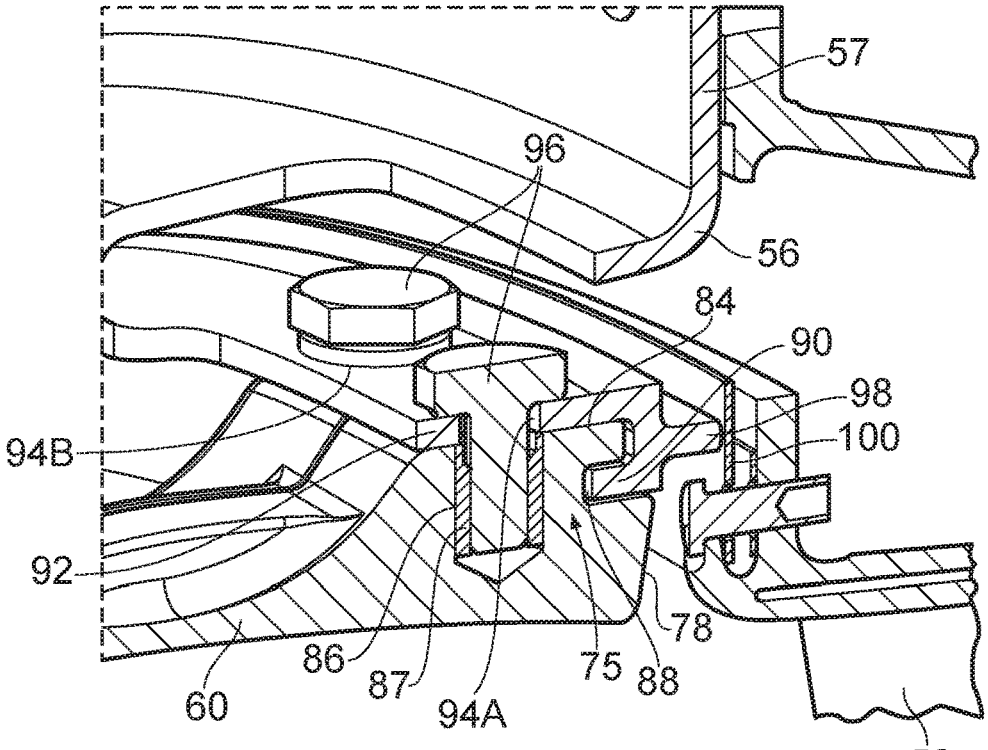
FIG. 8 is a further enlarged perspective view of the downstream end of the radially outer wall of the combustion chamber shown in FIG. 7.
Figure 9:
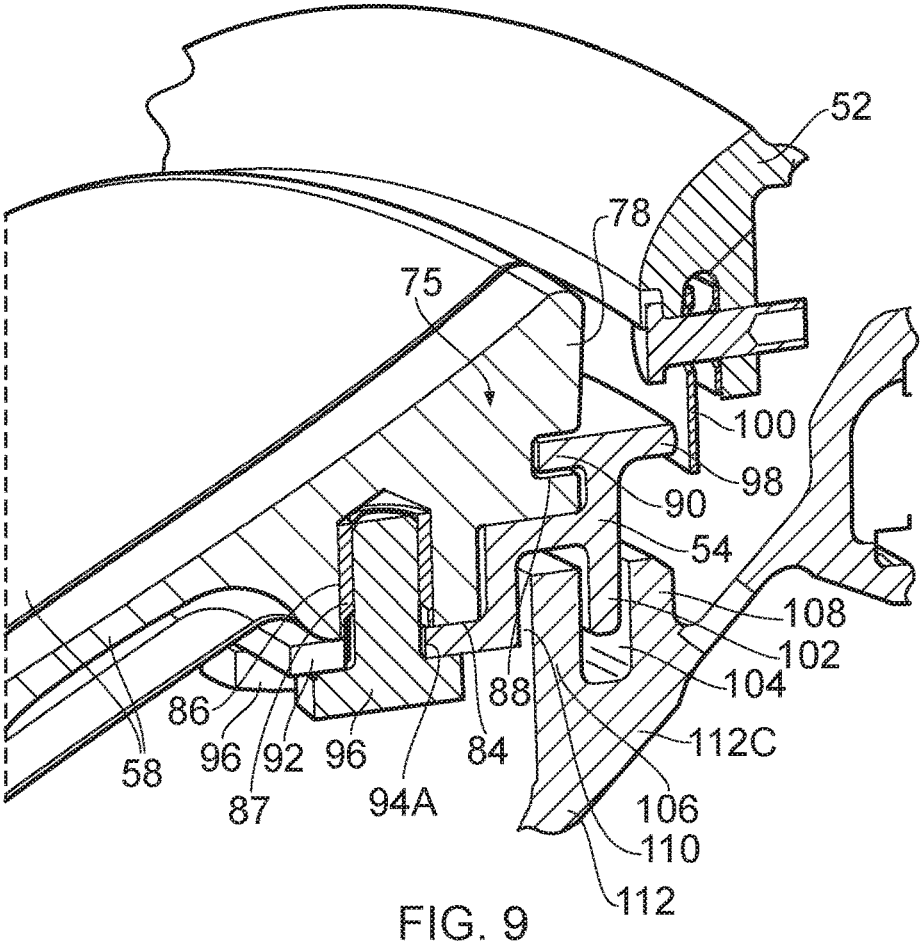
FIG. 9 is a further enlarged perspective view of the downstream end of the radially inner wall of the combustion chamber shown in FIG. 7.

FIGS. 7, 8 and 9 show the radially inner and radially outer downstream ring structures 54 and 56 and the downstream end walls 78 of the corresponding combustion chamber segments 58 and 60 in more detail. The frame structure 75 at the downstream end of each combustion chamber segment 58, 60 comprises a surface 84 having a plurality of circumferentially spaced radially extending bolt holes 86. The downstream edge of the frame structure 75 at the downstream end of each combustion chamber segment 58, 60 has a circumferentially and axially upstream extending groove 88, e.g. each combustion chamber segment 58, 60 has a circumferentially and axially upstream extending groove 88 provided in the downstream end wall 78. The corresponding downstream ring structure 54, 56 has an annular axially upstream extending hook 90 arranged to locate in the axially upstream extending groove 88 of each combustion chamber segment 58, 60 and the downstream ring structure 54, 56 has a portion 92 abutting the surface 84 of the frame structure 75 at the downstream end of each combustion chamber segment 58, 60. The downstream ring structure 54, 56 has a plurality of circumferentially spaced bolt holes 94 extending radially through the portion 92 abutting the surface 84 of the frame structure 75 of the combustion chamber segments 58 and 60. Each combustion chamber segment 58, 60 is removably secured to the corresponding downstream ring structure 54, 56 by a plurality of bolts 96 locatable in the bolt holes 86 in the combustion chamber segment 58, 60 and the corresponding bolt holes 94 in the corresponding downstream ring structure 54, 56. The downstream ring structure 54, 56 has an annular axially downstream extending member 98 and the annular axially downstream extending member 98 is arranged to form a seal with a radially extending flapper seal 100. The flapper seal 100 is mounted at one end to the high pressure nozzle guide vanes 52. The flapper seal 100 is a sprung strip of metal, which is arranged to push against the member 98.

FIG. 8 shows the radially outer downstream ring structure 56 in more detail and the radially outer downstream ring structure 56 abuts a radially outer surface 84 of the frame structure 75 of each combustion chamber segment 60. The radially outer downstream ring structure 56 comprises at least one U or V shaped portion 55 and an annular radially extending flange 57, each U or V shaped portion 55 has a radially inner limb 55A extending axially upstream from the portion 92 abutting the radially outer surface 84 of the frame structure 75, a bend 55B and a radially outer limb 55C extending axially downstream to the radially extending flange 57. In this example the radially outer downstream ring structure 56 comprises a plurality of circumferentially spaced U or V shaped portions 55 and each U or V shaped portion 55 has a radially inner limb 55A extending axially upstream from the portion 92 abutting the radially outer surface 84 of the frame structure 75, a bend 55B and a radially outer limb 55C extending axially downstream to the radially extending flange 57. The annular axially downstream extending member 98 is arranged to form a seal with a radially outwardly extending flapper seal 100 and the flapper seal 100 is mounted at its radially inner end to the high pressure nozzle guide vanes 52. The flapper seal 100 is a sprung strip of metal, which is arranged to push against the member 98. In this example there are ten U or V shaped portions 55, but more generally the number of U or V shaped portions 55 is the same as the number of combustion chamber segments 60.

The radially extending flange 57 is removably secured to the radially outer combustion chamber casing 110. The downstream end of the radially outer combustion chamber casing 110 is also removably secured to an upstream end of a turbine casing. In this example the radially extending flange 57 is removably secured to a flange at the downstream end of the radially outer combustion chamber casing 110 and a flange at the upstream end of the turbine casing by suitable fasteners, e.g. nuts and bolts.

The frame structure 75 comprises a plurality of bosses and each boss has a corresponding one of the bolt holes 86. In this example there are two bosses and two bolt holes 86 and the bosses are provided at the corners of the frame structure 75 at the downstream end of the combustion chamber segments 60. The bosses and the bolt holes 86 are arranged adjacent to the downstream ends of the first and second edge walls 80 and 82.

The radially outer downstream ring structure 56 has a plurality of first bolt holes 94A and a plurality of second bolt holes 94B. The first and second bolt holes 94A and 94B are arranged circumferentially alternately around the radially outer downstream ring structure 56. Each first bolt hole 94A has substantially the same diameter as the diameter of the bolt holes 86 in the frame structure 75 of the combustion chamber segments 60, but each second bolt hole 94B is circumferentially slotted. Each first bolt hole 94A is aligned axially and circumferentially with a bolt hole 86 in a corresponding combustion chamber segment 60 to circumferentially position the combustion chamber segment 60 relative to the radially outer downstream ring structure 56 and each second bolt hole 94B is aligned axially with another bolt hole 86 in the corresponding combustion chamber segment 60 to allow relative circumferential thermal expansion between the combustion chamber segment 60 and the radially outer downstream ring structure 56. A washer may be used with each bolt 96 located in a second bolt hole 94B. The bolt holes 86 may be threaded or may be provided with threaded inserts 87.

Thus, in one particular arrangement each first bolt hole 94A is aligned with the bolt hole 86 in the boss adjacent to the downstream end of the first edge wall 80 of a corresponding one of the combustion chamber segments 60 and each second bolt hole 94B is aligned with the bolt hole 86 in the boss adjacent to the downstream end of the second edge wall 82 of a corresponding one of the combustion chamber segments 60.

The bolt holes 94 in the portion 92 of the radially outer downstream ring structure 56 are positioned circumferentially between adjacent U or V shaped portions 55 of the radially outer downstream ring structure 56. Additionally, the bolt holes 86 at the corners of the frames 75 of the combustion chamber segments 60 and the bolts 96 are also positioned circumferentially between adjacent U or V shaped portions 55 of the radially outer downstream ring structure 56. Thus, the edges of the combustion chamber segments at the downstream end of the combustion chamber segments 60 are positioned circumferentially between the U or V shaped portions 55 of the radially outer downstream ring structure 56.

Thus, it is to be noted that the radially outer downstream ring structure 56 is located radially around the downstream ends of the combustion chamber segments 60 and the radially outer downstream ring structure 56 abuts the radially outer surface 84 of the frame structure 75 of each combustion chamber segment 60. In addition the annular hook 90 on the radially outer downstream ring structure 56 locates in the grooves 88 at the downstream ends of the combustion chamber segments 60. These features provide radial restraint against radial outward movement of the combustion chamber segments 60.

FIG. 9 shows the radially inner downstream ring structure 54 in more detail and the radially inner downstream ring structure 54 abuts a radially inner surface 84 of the frame structure 75 of each combustion chamber segment 58. The radially inner downstream ring structure 54 comprises an annular radially inwardly extending flange 102. The radially inwardly extending flange 102 is removably located in a radially extending groove 104 on the radially inner combustion chamber casing 112. The annular radially extending groove 104 is defined between two annular radially outwardly extending flanges 106 and 108 on the radially inner combustion chamber casing 112. For example the radially extending groove 104 and the annular radially outwardly extending flanges 106 and 108 are provided on the downstream portion 112C of the radially inner combustion chamber casing 112. The radially outwardly extending flange 106 is arranged to locate in an annular radially outwardly extending groove 110 on the radially inner downstream ring structure 54.

The frame structure 75 comprises a plurality of bosses and each boss has a corresponding one of the bolt holes 86. In this example there are two bosses and two bolt holes 86 and the bosses are provided at the corners of the frame structure 75 at the downstream end of the combustion chamber segments 58. The bosses and the bolt holes 86 are arranged adjacent to the downstream ends of the first and second edge walls 80 and 82.

The radially inner downstream ring structure 54 has a plurality of first bolt holes 94A and a plurality of second bolt holes 94B. The first and second bolt holes 94A and 94B are arranged circumferentially alternately around the radially inner downstream ring structure 54. Each first bolt hole 94A has substantially the same diameter as the diameter of the bolt holes 86 in the frame structure 75 of the combustion chamber segments 58, but each second bolt hole 94B is circumferentially slotted. Each first bolt hole 94A is aligned axially and circumferentially with a bolt hole 86 in a corresponding combustion chamber segment 58 to circumferentially position the combustion chamber segment 58 relative to the radially inner downstream ring structure 54 and each second bolt hole 94B is aligned axially with another bolt hole 86 in the corresponding combustion chamber segment 58 to allow relative circumferential thermal expansion between the combustion chamber segment 58 and the radially inner downstream ring structure 54. A washer may be used with each bolt 96 located in a second bolt hole 94B. The bolt holes 86 may be threaded or may be provided with threaded inserts 87.

Thus, in one particular arrangement each first bolt hole 94A is aligned with the bolt hole 86 in the boss adjacent to the downstream end of the first edge wall 80 of a corresponding one of the combustion chamber segments 58 and each second bolt hole 94B is aligned with the bolt hole 86 in the boss adjacent to the downstream end of the second edge wall 82 of a corresponding one of the combustion chamber segments 58.

Thus, it is to be noted that the radially inner downstream ring structure 54 is located radially within the downstream ends of the combustion chamber segments 58 and the radially inner downstream ring structure 54 abuts the radially outer surface 84 of the frame structure 75 of each combustion chamber segment 58. In addition the annular hook 90 on the radially inner downstream ring structure 54 locates in the grooves 88 at the downstream ends of the combustion chamber segments 58. These features provide radial restraint against radial inward movement of the combustion chamber segments 60.

The radially inner and radially outer downstream ring structures 54 and 56 may be manufactured by forging a ring and then machining, for example turning, the forged ring.

The surfaces 84 of the frame structure 75 of the combustion chamber segments 58 and 60 and the portions 92 of the corresponding downstream ring structures 54 and 56 are arranged parallel to the axis of the annular combustion chamber 15. The grooves 88 in the frames 75 of the combustion chamber segments 58 and the hooks 90 of the corresponding downstream ring structures 54 and 56 are arranged parallel to the axis of the annular combustion chamber 15.

The combustion chamber segments 58 and 60 have dilution apertures 114 to supply air for mixing into the annular combustion chamber 15. However, if the annular combustion chamber 15 is a lean burn combustion chamber, the combustion chamber segments 58 and 60 do not require dilution apertures.

Figure 10:
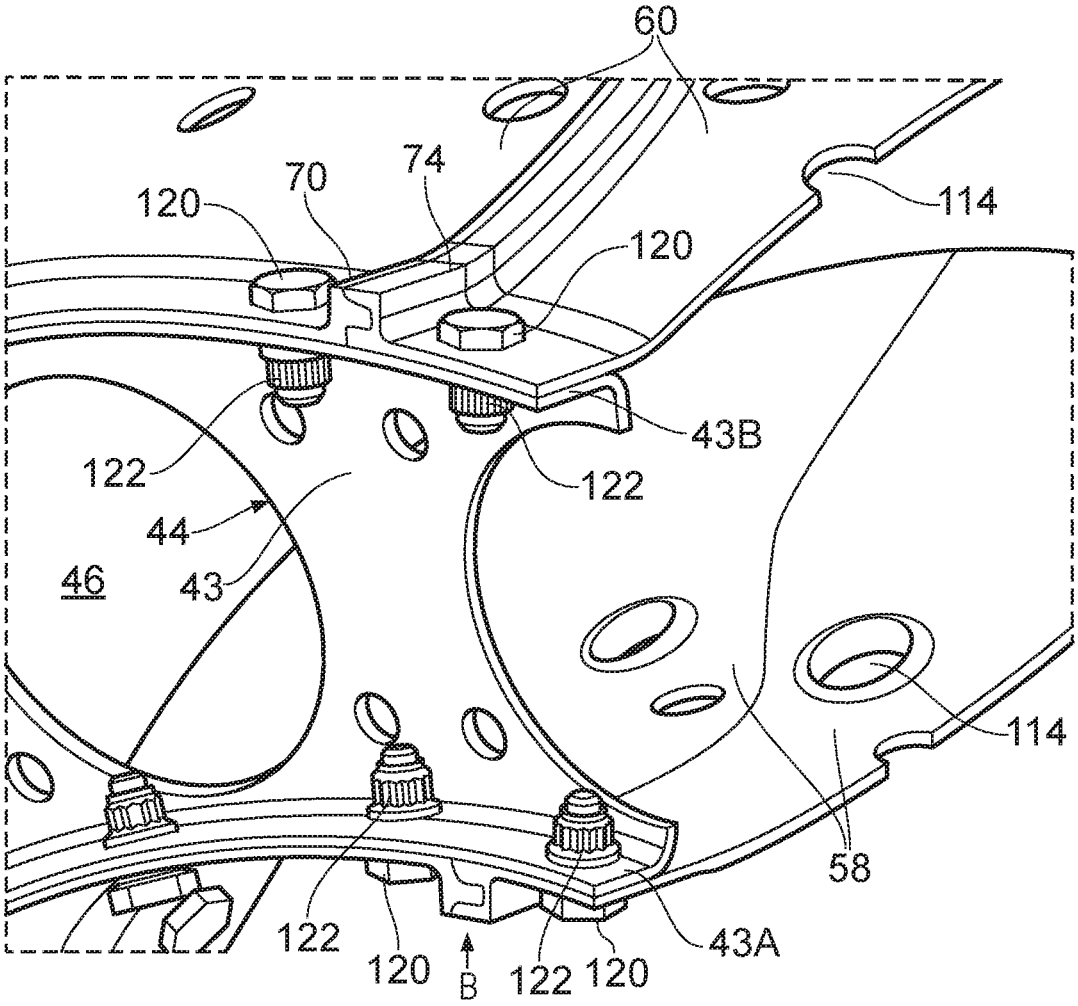
FIG. 10 is a further enlarged cut-away perspective view of the upstream ends of the radially inner and radially outer walls and the upstream end wall of the combustion chamber shown in FIG. 7.
Figure 11:
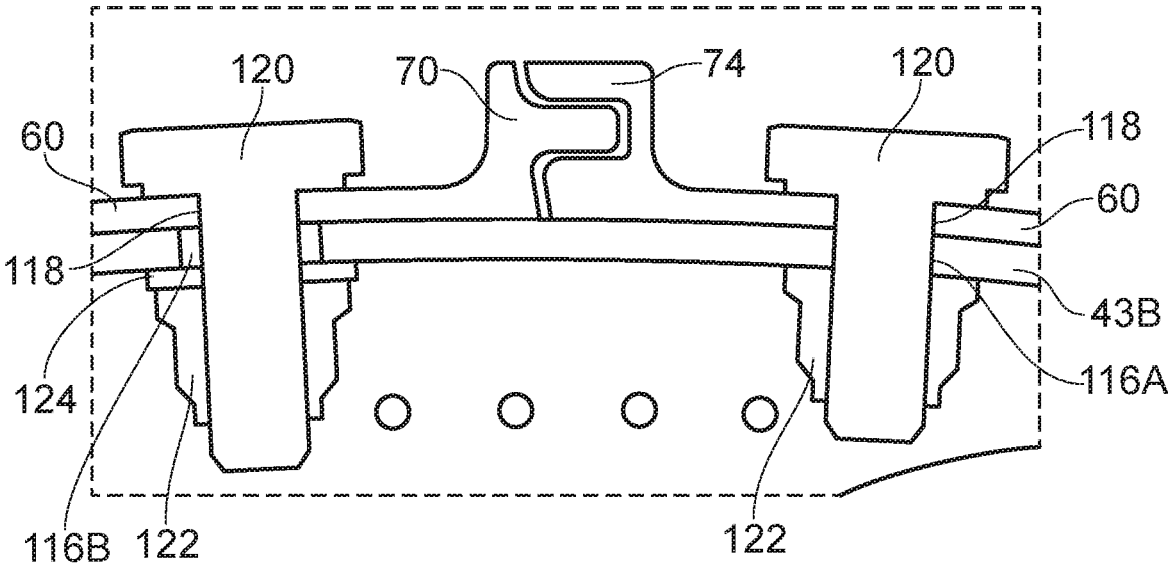
FIG. 11 is a further enlarged cross-sectional view through the portions of the edges of two adjacent combustion chamber segments of the radially outer wall in a plane perpendicular to the axis of the combustion chamber shown in FIG. 10.
Figure 12:
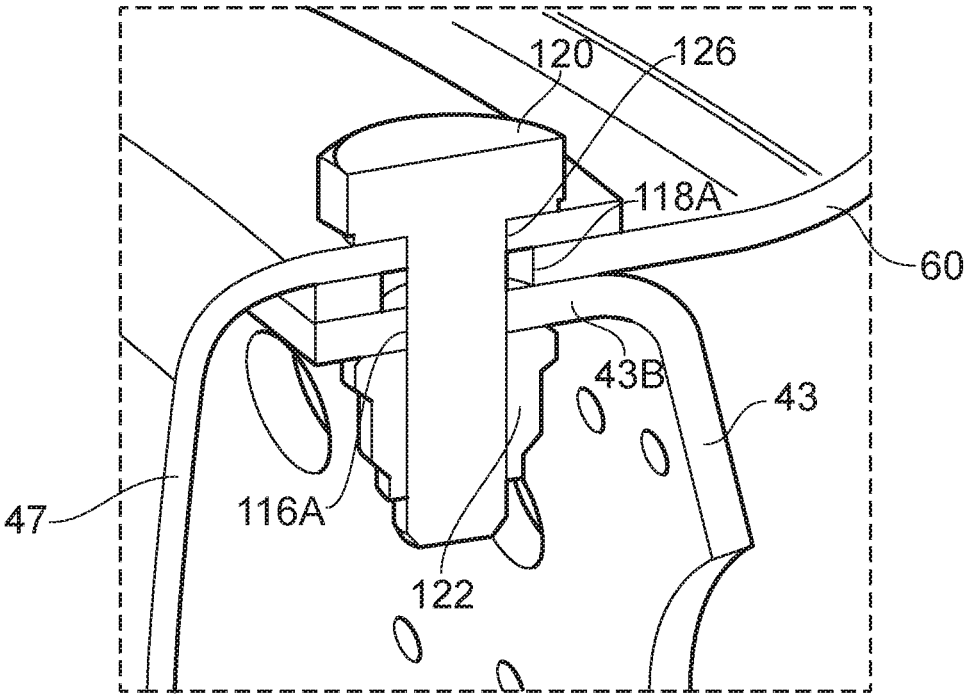
FIG. 12 is a further enlarged cross-sectional view through the upstream end of the combustion chamber in a plane containing the axis of the combustion chamber shown in FIG. 7.

The following description is made with regard to FIGS. 10-14. FIGS. 10 and 11 show the upstream end wall 43 and the upstream ends of the combustion chamber segments 58 and 60. FIG. 12 shows the fixing of the cowl 47 to the upstream end wall 43 of the combustion chamber 40 using bolts 132 and nuts 134. As mentioned previously the upstream end of each combustion chamber segment 58, 60 is secured, e.g. removably secured, to the upstream ring structure 43. Thus, the upstream end of each combustion chamber segment 58 is secured to the upstream ring structure, e.g. to the inner annular flange 43A extending in an axially upstream direction from the upstream end wall 43 and the upstream end of each combustion chamber segment 60 is secured to the upstream ring structure, e.g. to the outer annular flange 43B extending in an axially upstream direction from the upstream end wall 43. The upstream end of each combustion chamber segment 58 is positioned radially within and abutting the inner annular flange 43A of the upstream end wall 43 and the upstream end of each combustion chamber segment 60 is positioned radially outside and abutting the outer annular flange 43B of the upstream end wall 43. The inner and outer flanges 43A and 43B are preferably parallel to the axis X-X of the gas turbine engine 10. Each combustion chamber segment 58 has a minimum of two bolt holes The upstream end of each combustion chamber segment 58 has at least two bolt holes 118 and the two bolt holes 118 are provided at the corners of the combustion chamber segments 58. The bolt holes 118 are arranged adjacent the downstream ends of the first and second edge walls 80 and 82 and adjacent the first and second hooks 70 and 74. Some of the bolt holes 118 are cylindrical and the remainder of the bolt holes 118 are axially slotted to allow for manufacturing tolerances. The bolt holes 118 extend radially through each combustion chamber segment 58.

The inner annular flange 43A has a plurality of first bolt holes 116A and a plurality of second bolt holes 1168. The first and second bolt holes 116A and 1168 extend radially through the inner annular flange 43A. The first and second bolt holes 116A and 1168 are arranged circumferentially alternately around the inner annular flange 43A of the upstream end wall 43, e.g.; the radially inner upstream ring structure. Each first bolt hole 116A is cylindrical and has substantially the same diameter as the diameter of the bolt holes 118 in the upstream end of the combustion chamber segments 58, but each second bolt hole 1168 is circumferentially slotted. Each first bolt hole 116A is aligned axially and circumferentially with a bolt hole 118 in a corresponding combustion chamber segment 58 to circumferentially position the combustion chamber segment 58 relative to the radially inner upstream ring structure, the inner annular flange 43A of the upstream end wall 43 and each second bolt hole 1168 is aligned axially with another bolt hole 118 in the corresponding combustion chamber segment 58 to allow relative circumferential thermal expansion between the combustion chamber segment 58 and the radially inner upstream ring structure, the inner annular flange 43A of the upstream end wall 43. The bolts 120 are threaded into respective nuts 122. A washer 124 may be used with each bolt 120 located in a second bolt hole 1168. The heads of the bolts 120 abut the upstream ends of the combustion chamber segments 58 and the washers 124 are provided the between the nuts 124 and the inner annular flange 43A. Alternatively, the nuts 122 may abut the upstream ends of the combustion chamber segments 58 and the washers 124 are provided the between the heads of the bolts 120 and the inner annular flange 43A. The bolts 120 extend radially with respect to the axis of the gas turbine engine 10. The bolt holes 118 pass through thickened portions 119 of the upstream ends of the combustion chamber segments 58 to manage the stresses. Additionally, or alternatively, the bolt holes 116A, 116B pass through thickened portions of the inner annular flange 43A to manage the stresses.

Similarly, the upstream end of each combustion chamber segment 60 has at least two bolt holes 118 and the two bolt holes 118 are provided at the corners of the combustion chamber segments 60. The bolt holes 118 are arranged adjacent the downstream ends of the first and second edge walls 80 and 82 and adjacent the first and second hooks 70 and 74. The bolt holes 118 extend radially through each combustion chamber segment 60. All of the bolt holes 118 are axially slotted to allow manufacturing tolerances and adjustment of the axial distance between the radially inner and outer downstream rings 54 and 56 and the fuel injector apertures.

The outer annular flange 43B has a plurality of first bolt holes 116A and a plurality of second bolt holes 116B. The first and second bolt holes 116A and 116B extend radially through the outer annular flange 43B. The first and second bolt holes 116A and 116B are arranged circumferentially alternately around the outer annular flange 43B of the upstream end wall 43, e.g. the radially outer upstream ring structure. Each first bolt hole 116A is cylindrical and has substantially the same diameter as the diameter of the bolt holes 118 in the upstream end of the combustion chamber segments 60, but each second bolt hole 116B is circumferentially slotted. Each first bolt hole 116A is aligned axially and circumferentially with a bolt hole 118 in a corresponding combustion chamber segment 60 to circumferentially position the combustion chamber segment 60 relative to the radially outer upstream ring structure, the outer annular flange 43B of the upstream end wall 43 and each second bolt hole 116B is aligned axially with another bolt hole 118 in the corresponding combustion chamber segment 60 to allow relative circumferential thermal expansion between the combustion chamber segment 60 and the radially outer upstream ring structure, the outer annular flange 43B of the upstream end wall 43. The bolts 120 are threaded into respective nuts 122. A washer 124 may be used with each bolt 120 located in a second bolt hole 116B. The heads of the bolts 120 abut the upstream ends of the combustion chamber segments 60 and the washers 124 are provided the between the nuts 124 and the outer annular flange 43B. Alternatively, the nuts 122 may abut the upstream ends of the combustion chamber segments 60 and the washers 124 are provided the between the heads of the bolts 120 and the outer annular flange 43B. The bolts 120 extend radially with respect to the axis of the gas turbine engine 10. The bolt holes 118 pass through thickened portions 119 of the upstream ends of the combustion chamber segments 60 to manage the stresses. Additionally, or alternatively, the bolt holes 116A, 116B pass through thickened portions of the outer annular flange 43B to manage the stresses.

Figure 13:
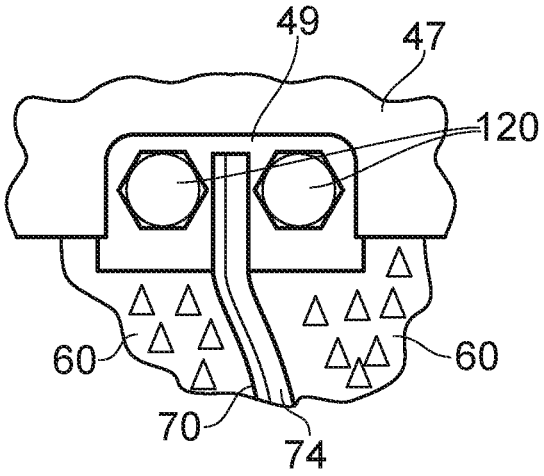
FIG. 13 is view in the direction of arrow B in FIG. 10.
Figure 14:
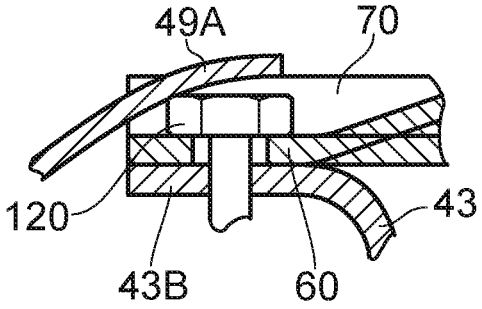
FIG. 14 is a cross-sectional view through the cowl and upstream end wall and a combustion chamber segment.

FIG. 12 shows the fixing of the cowl 47 to the upstream end wall 43 of the combustion chamber 40 using bolts 120 and nuts 122. A number of bolt holes 126 are positioned circumferentially around the cowl 47 with a corresponding bolt hole 118A in each of the combustion chamber segments 58, 60 and corresponding bolt holes 116A the inner annular flange 43A (Not shown in FIG. 12, see FIG. 10) and the outer annular flange 43B. The bolt holes 116A in the inner annular flange 43A and the outer annular flange 43B are cylindrical. The bolt hole 118A in each combustion chamber segment 58, 60 is cylindrical but has a larger diameter than the bolt holes 116A. Three bolt holes 126 in the cowl 47 are cylindrical and have the same diameter as the bolt holes 116A and the remaining bolt holes 126 are circumferentially slotted to allow for manufacturing tolerances and to allow relative thermal expansion and contraction. The bolt holes 118A in the combustion chamber segments 58 and 60 are oversized to account for manufacturing tolerances and to allow thermal expansion and contraction of the combustion chamber segments 58 and 60 without imparting loads into the bolts securing the cowl 47 to the upstream end wall 43. It is to be noted that the cowl 47 is provided with a plurality of scallops, or cut-backs, 49 on both its radially outer axially extending flange and its radially inner axially extending flange, as shown in FIG. 13. Each scallop, cut back, 49 is located at an interface between adjacent combustion chamber segments 58 or at an interface between adjacent combustion chamber segments 60. Each scallop 49 comprises a region where the downstream end of the cowl 47 is locally positioned axially upstream of the remainder of the downstream end of the cowl 47. The bolts securing two adjacent combustion chamber segments 58 to the radially inner flange 43A and the hooks 70, 74 of the two adjacent combustion chamber segments 58 are located in a respective one of the scallops 49 and the bolts securing two adjacent combustion chamber segments 60 to the radially outer flange 43B and the hooks 70, 74 of the two adjacent combustion chamber segments 60 are located in a respective one of the scallops 49. Alternatively, the cowl 47 may have a plurality of local flaps 49A, as shown in FIG. 14, and each local flap 49A is shaped to fit over the bolts 120 securing two adjacent combustion chamber segments 58 or 60 to the radially inner flange 43A or radially outer flange 43B and the hooks 70, 74 of the two adjacent combustion chamber segments 58 or 60. These arrangements allow the cowl 47 to be removed without disassembling the combustion chamber segments 58, 60 from the upstream end wall 43 and enable in-service replacement and or repair of upstream end wall accessories, e.g. heat shield segments 45, fuel injector seals etc. The nuts 122 may be captive nuts for example nuts riveted to the flanges 43A and 43B of the upstream end wall 43.

The edges of the combustion chamber segments are S shaped, but may be W shaped or straight, e.g. the edges of the combustion chamber segments may extend with a purely axial component from the upstream end to the downstream end of the combustion chamber segment or the edges of the combustion chamber segments may extend with axial and circumferential component from the upstream end to the downstream end of the combustion chamber segment.

The apertures 69 in the outer wall 64 provide impingement cooling of the inner wall 66 and that the apertures 67 in the inner wall 66 provide effusion cooling of the inner wall 66. The effusion cooling apertures 67 may be angled at an acute angle to the inner surface of the inner wall 66 and apertures 67 may be fan shaped. Other cooling arrangements may be possible for the combustion chamber segments 58 and 60, e.g. a cellular structure may be provided between the inner and outer walls.

It is to be noted that the radially outer downstream ring structure 56 is a separate structure to the upstream end wall 43 and the radially inner downstream ring structure 54 is a separate structure to the upstream end wall, upstream ring structure, 43.

The combustion chamber segments 58, 60 may be cylindrical, frusto-conical or have a curved profile when viewed in axial cross-section through an annular combustion chamber.

An advantage of the present disclosure is that there is a relatively large surface area of engagement between the radially inner downstream ring structure and the combustion chamber segments forming the radially inner annular wall of the annular combustion chamber and there is a relatively large surface area of engagement between the radially outer downstream ring structure and the combustion chamber segments forming the radially outer annular wall of the annular combustion chamber to provide radial restraint of the combustion chamber segments. This is of particular advantage during ultimate load situations, e.g. during compressor surge or combustion chamber flame out, when relatively high radial loads are exerted onto the combustion chamber segments tending to force the combustion chamber segments of the radially outer annular wall of the annular combustion chamber radially outwardly and to force the combustion chamber segments of the radially inner annular wall of the annular combustion chamber radially inwardly.

Another advantage of the present disclosure is that it allows for differential thermal expansion and/or contraction between the combustion chamber segments and the corresponding downstream ring structure without inducing relatively stresses in the combustion chamber segments and/or the corresponding downstream ring structure.

A further benefit is that the combustion chamber loads are transmitted into the frame structure of the combustion chamber segments and not into the inner wall and/or outer wall of the combustion chamber segments.

An additional benefit is that the combustion chamber segments are removably secured to the corresponding downstream ring structure which allows the combustion chamber segments to be repaired, or replaced. Thus, the combustion chamber segments may have a shorter working life than the corresponding downstream ring structure.

An advantage of the present disclosure is that the fasteners at the upstream ends of the combustion chamber segments radially and axially restrain the combustion chamber segments relative to the upstream end wall of the combustion chamber during normal operation and also during ultimate load situations, e.g. during compressor surge or combustion chamber flame out, when relatively high radial loads are exerted onto the combustion chamber segments tending to force the combustion chamber segments of the radially outer annular wall of the annular combustion chamber radially outwardly and to force the combustion chamber segments of the radially inner annular wall of the annular combustion chamber radially inwardly.

A further benefit is that the fasteners at the upstream ends of the combustion chamber segments allow the combustion chamber segments to be removed from the upstream end wall of the combustion chamber and replaced if the combustion chamber segments are damaged or to be repaired and reinserted into the combustion chamber.

Another benefit of the fastener arrangement is that there are low stresses in the portions of the combustion chamber segments which have cooling arrangements.

Although the present disclosure has referred to an annular combustion chamber in which combustion chamber segments form a radially outer annular wall and combustion chamber segments form a radially inner annular it is equally applicable to an annular combustion chamber in which combustion chamber segments only form a radially outer annular wall or to an annular combustion chamber in which combustion chamber segments only form a radially inner annular wall.

Although the present disclosure has referred to combustion chamber segments comprising an integral frame, an inner wall and an outer wall it is equally possible for the combustion chamber segments to comprise an integral frame and an inner wall.

Although the present disclosure has referred to an annular combustion chamber in which combustion chamber segments form a radially outer annular wall and combustion chamber segments form a radially inner annular it is equally applicable to a tubular combustion chamber.

Although the present disclosure has referred to providing bolt holes in the frame at the downstream ends of the combustion chamber segments with the same diameter and two sets of apertures in the associated downstream ring structure in which the holes of the first and second holes are arranged circumferentially alternatively around the ring and in which the bolt holes of one set have the same diameter as the bolt holes in the combustion chamber segments and the bolt holes of the other set are circumferentially slotted, it is equally possible to have the opposite arrangement. In the opposite arrangement all the bolt holes in the downstream ring structure have same diameter and each combustion chamber segment has a first bolt hole and a second bolt hole in the frame structure of the combustion chamber segment and each first bolt hole has the same diameter as the diameter of the bolt holes in the downstream ring structure and each second bolt hole is circumferentially slotted.

Although the description has referred to the use of bolts and threaded holes or bolts and threaded inserts to removably secure the combustion chamber segments to the radially inner and radially outer downstream ring structures other suitable fasteners may be used, e.g. nuts and bolts, screws, rivets, pins and clips.

Although the description has referred to the use of nuts and bolts to removably secure the radially inner and radially outer downstream ring structures to the inner and outer combustion chamber casings other suitable fasteners may be used, e.g. bolts and threaded holes, bolts and threaded inserts, screws, rivets, pins and clips.

Although the description has referred to the use of bolts and nuts to removably secure the combustion chamber segments to the radially inner and radially outer upstream ring structures other suitable fasteners may be used, e.g. screws, rivets, pins and clips.

The combustion chamber may be a gas turbine engine combustion chamber.

The gas turbine engine may be an aero gas turbine engine, a marine gas turbine engine, an industrial gas turbine engine or an automotive gas turbine engine.

The aero gas turbine engine may be a turbofan gas turbine engine, a turbojet gas turbine engine, a turbo propeller gas turbine engine or a turbo shaft gas turbine engine.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A combustion chamber comprising:

a downstream ring structure;

a plurality of circumferentially-arranged combustion chamber segments, each combustion chamber segment of the plurality of combustion chamber segments extending a full length of the combustion chamber, each combustion chamber segment including a frame structure integral with an inner wall;

an upstream ring structure having a portion abutting a surface of an upstream end of each combustion chamber segment of the plurality of combustion chamber segments, the upstream end of each combustion chamber segment of the plurality of combustion chamber segments being secured to the upstream ring structure and having a plurality of circumferentially-spaced radially-extending chamber holes, and a downstream end of each combustion chamber segment is mounted on the downstream ring structure;

a plurality of circumferentially-spaced ring holes extending radially through the portion of the upstream ring structure and each combustion chamber segment of the plurality of combustion chamber segments being removably secured to the upstream ring structure by a plurality of fasteners disposed in the plurality of chamber holes and corresponding ring holes; and a cowl having a downstream end including a plurality of circumferentially-spaced flaps, each flap of the plurality of flaps being located at an interface between two adjacent combustion chamber segments of the plurality of combustion chamber segments, wherein the plurality of chamber holes includes:

a first chamber hole corresponding with a first ring hole of the plurality of ring holes to circumferentially position a corresponding combustion chamber segment relative to the upstream ring structure, and a second chamber hole corresponding with a second ring hole of the plurality of ring holes to allow relative circumferential thermal expansion between the combustion chamber segment and the upstream ring structure, and either (i) the second chamber hole is wider than the first chamber hole in a circumferential direction of the combustion chamber, or (ii) the second ring hole is wider than the first ring hole in the circumferential direction of the combustion chamber, such that a gap is formed between a corresponding fastener of the plurality of fasteners and sides of the second chamber hole or sides of the second ring hole when the corresponding fastener fastens the corresponding combustion chamber segment to the upstream ring via the second chamber hole and the second ring hole, and wherein the plurality of fasteners include at least one bolt securing two adjacent combustion chamber segments of the plurality of combustion chamber segments to the upstream ring structure, the at least one bolt being disposed under a respective flap of the plurality of flaps such that a head of the at least one bolt is covered by the respective flap of the plurality of flaps.

2. The combustion chamber as claimed in claim 1, wherein the plurality of ring holes includes a plurality of first ring holes and a plurality of second ring holes, the plurality of first ring holes and the plurality of second ring holes being arranged circumferentially and alternately around the upstream ring structure, each second ring hole being circumferentially slotted, each first ring hole being aligned axially and circumferentially with a corresponding first chamber hole of the plurality of chamber holes and each second ring hole being aligned axially with a corresponding second chamber hole of the plurality of chamber holes to allow relative circumferential thermal expansion between the combustion chamber segment and the upstream ring structure, each first ring hole of the plurality of first ring holes having a same diameter as a diameter of the first chamber hole of the plurality of chamber holes.

3. The combustion chamber as claimed in claim 1, wherein the first and second chamber holes of the plurality of chamber holes are arranged circumferentially alternately, each first chamber hole has a same diameter as a diameter of the plurality of ring holes, each second chamber hole is circumferentially slotted, each first chamber hole is aligned axially and circumferentially with a corresponding ring hole of the plurality of ring holes, and each second chamber hole is aligned axially with a corresponding ring hole of the plurality of ring holes to allow relative circumferential thermal expansion between the combustion chamber segment and the upstream ring structure.

4. The combustion chamber as claimed in claim 1, wherein the plurality of fasteners include nuts and bolts.

5. The combustion chamber as claimed in claim 1, wherein the combustion chamber is selected from a group consisting of an annular combustion chamber and a tubular combustion chamber.

6. The combustion chamber as claimed in claim 5, wherein the combustion chamber segments form a radially outer annular wall of the annular combustion chamber.

7. The combustion chamber as claimed in claim 6, wherein the combustion chamber segments form a radially inner annular wall of the annular combustion chamber.

8. The combustion chamber as claimed in claim 1, wherein the combustion chamber is in a gas turbine engine.

9. The combustion chamber as claimed in claim 8, wherein the gas turbine engine is an aero gas turbine engine, a marine gas turbine engine, an industrial gas turbine engine, or an automotive gas turbine engine.

10. The combustion chamber as claimed in claim 9, wherein the aero gas turbine engine is a turbofan gas turbine engine, a turbojet gas turbine engine, a turbo propeller gas turbine engine, or a turbo shaft gas turbine engine.

11. The combustion chamber as claimed in claim 1, wherein at least some chamber holes of the plurality of chamber holes extending radially through the upstream end of each combustion chamber segment are axially slotted.

12. The combustion chamber as claimed in claim 1, wherein the cowl is secured to the upstream ring structure, the cowl including a plurality of circumferentially-spaced radially-extending cowl holes, the cowl being removably secured to the upstream ring structure by a plurality of fasteners disposed in the plurality of cowl holes corresponding to the plurality of chamber holes in the combustion chamber segments and the plurality of ring holes in the upstream ring structure.

13. The combustion chamber as claimed in claim 12, wherein:

the corresponding chamber holes of the plurality of chamber holes are cylindrical and have a larger diameter than the corresponding ring holes of the plurality of ring holes, a first plurality of cowl holes are cylindrical and have a same diameter as the diameter of the corresponding ring holes of the plurality of ring holes, and a second plurality of cowl holes are circumferentially slotted.

14. The combustion chamber as claimed in claim 1, wherein:

each combustion chamber segment includes a box structure, the box structure including:

the frame structure, the inner wall, and an outer wall, and the frame structure, the inner wall, and the outer wall are integral.

15. The combustion chamber as claimed in claim 1, wherein each combustion chamber segment includes a first edge and a second edge spaced circumferentially from the first edge, the first edge of each combustion chamber segment of the plurality of combustion chamber segments having a first hook arranged at a first radial distance, the second edge of each combustion chamber segment of the plurality of combustion chamber segments having a second hook arranged at a second radial distance, the second radial distance being greater than the first radial distance, the first hook of each combustion chamber segment of the plurality of combustion chamber segments engaging the second edge of an adjacent combustion chamber segment of the plurality of combustion chamber segments and the second hook of each combustion chamber segment of the plurality of combustion chamber segments engaging the first hook of an adjacent combustion chamber segment of the plurality of combustion chamber segments.

16. A combustion chamber comprising:

a downstream ring structure;

a plurality of circumferentially-arranged combustion chamber segments, each combustion chamber segment of the plurality of combustion chamber segments extending a full length of the combustion chamber, each combustion chamber segment including a frame structure integral with an inner wall;

an upstream ring structure having a portion abutting a surface of an upstream end of each combustion chamber segment of the plurality of combustion chamber segments, the upstream end of each combustion chamber segment of the plurality of combustion chamber segments being secured to the upstream ring structure and having a plurality of circumferentially-spaced radially-extending chamber holes, and a downstream end of each combustion chamber segment is mounted on the downstream ring structure;

a plurality of first ring holes and a plurality of second ring holes extending radially through the portion of the upstream ring structure abutting the surface of the upstream end of each combustion chamber segment of the plurality of combustion chamber segments; and a cowl having a downstream end including a plurality of circumferentially-spaced flaps, each flap of the plurality of flaps being located at an interface between two adjacent combustion chamber segments of the plurality of combustion chamber segments, wherein:

each combustion chamber segment of the plurality of combustion chamber segments is removably secured to the upstream ring structure by a plurality of fasteners disposed in the plurality of chamber holes in the combustion chamber segment and corresponding ring holes of the plurality of ring holes in the upstream ring structure, the plurality of first ring holes and the plurality of second ring holes are arranged circumferentially and alternately around the upstream ring structure, the second chamber hole has a same width as the first chamber hole in the circumferential direction of the combustion chamber, each first ring hole having a same diameter as a diameter of the plurality of chamber holes, each second ring hole being circumferentially slotted, each first ring hole being aligned axially and circumferentially with a first chamber hole of the plurality of chamber holes in a corresponding combustion chamber segment of the plurality of combustion chamber segments and each second ring hole being aligned axially with a second chamber hole of the plurality of chamber holes in the corresponding combustion chamber segment to allow relative circumferential thermal expansion between the corresponding combustion chamber segment and the upstream ring structure, and the second ring hole is wider than the first ring hole in the circumferential direction of the combustion chamber, such that a gap is formed between a corresponding fastener of the plurality of fasteners and sides of the second ring hole when the corresponding fastener fastens the corresponding combustion chamber segment to the upstream ring via the second chamber hole and the second ring hole, and the plurality of fasteners include at least one bolt securing two adjacent combustion chamber segments of the plurality of combustion chamber segments to the upstream ring structure, the at least one bolt being disposed under a respective flap of the plurality of flaps such that a head of the at least one bolt is covered by the respective flap of the plurality of flaps.

17. A combustion chamber comprising:

a downstream ring structure;

a plurality of circumferentially-arranged combustion chamber segments, each combustion chamber segment of the plurality of combustion chamber segments extending a full length of the combustion chamber, each combustion chamber segment including a frame structure integral with an inner wall;

an upstream ring structure having a portion abutting a surface of an upstream end of each combustion chamber segment of the plurality of combustion chamber segments, the upstream end of each combustion chamber segment of the plurality of combustion chamber segments being secured to the upstream ring structure and having a plurality of circumferentially-spaced radially-extending chamber holes, and a downstream end of each combustion chamber segment is mounted on the downstream ring structure; and a cowl having a downstream end including a plurality of circumferentially-spaced flaps, each flap of the plurality of flaps being located at an interface between two adjacent combustion chamber segments of the plurality of combustion chamber segments, wherein:

the frame structure at the upstream end of each combustion chamber segment of the plurality of combustion chamber segments has a first chamber hole and a circumferentially-spaced second chamber hole, the first and second chamber holes of the combustion chamber segments being arranged circumferentially and alternately, the upstream ring structure includes a portion abutting the surface of the upstream end of each combustion chamber segment of the plurality of combustion chamber segments, a plurality of circumferentially-spaced ring holes extending radially through the portion of the upstream ring structure abutting the surface of the upstream end of each combustion chamber segment, each combustion chamber segment of the plurality of combustion chamber segments being removably secured to the upstream ring structure by a plurality of fasteners disposed in the plurality of chamber holes in the combustion chamber segment and corresponding ring holes of the plurality of ring holes in the upstream ring structure, each first chamber hole having the same diameter as the diameter of the plurality of ring holes in the upstream ring structure, each second chamber hole being circumferentially-slotted, each first chamber hole being aligned axially and circumferentially with a corresponding first ring hole of the plurality of ring holes in the upstream ring structure and each second chamber hole being aligned axially with a corresponding second ring hole of the plurality of ring holes in the upstream ring structure to allow relative circumferential thermal expansion between the combustion chamber segment and the upstream ring structure, the second ring hole has a same width as the first ring hole in the circumferential direction of the combustion chamber, and the second chamber hole is wider than the first chamber hole in a circumferential direction of the combustion chamber, such that a gap is formed between a corresponding fastener of the plurality of fasteners and sides of the second chamber hole when the corresponding fastener fastens the corresponding combustion chamber segment to the upstream ring via the second chamber hole and the second ring hole, and the plurality of fasteners include at least one bolt securing two adjacent combustion chamber segments of the plurality of combustion chamber segments to the upstream ring structure, the at least one bolt being disposed under a respective flap of the plurality of flaps such that a head of the at least one bolt is covered by the respective flap of the plurality of flaps.

* * * * *